US005179351A

United States Patent [19]

Ikegami

[11] Patent Number: 5,179,351

[45] Date of Patent: Jan. 12, 1993

[54] VACUUM PIPE FOR SYNCHROTRON ORBIT RADIATION DEVICE

[75] Inventor: Kazunori Ikegami, Amagasaki, Japan

[73] Assignee: Mitsubishi Denki Kabushiki Kaisha, Tokyo, Japan

[21] Appl. No.: 752,000

[22] Filed: Aug. 29, 1991

[30] Foreign Application Priority Data

Aug. 31, 1990 [JP] Japan ..... 2-228019

[51] Int. Cl.[5] ..... H05H 13/04

[52] U.S. Cl. ..... 328/235

[58] Field of Search ..... 328/235

[56] References Cited

U.S. PATENT DOCUMENTS 3,328,708 6/1967 Smith et al. ..... 328/235

4,996,496 2/1991 Kitamura et al. ..... 328/235 X

FOREIGN PATENT DOCUMENTS 269500 11/1988 Japan ..... 328/235

OTHER PUBLICATIONS

Banthau, J. Kouptsidis, R., and H. Hartwig, A Novel Fabrication Technique For Thin Metallic Vacuum Chambers With Low Eddy Current Losses, IEEE Transactions on Nuclear Science, Oct., 1985.

*Primary Examiner*—Palmer C. DeMeo

*Attorney, Agent, or Firm*—Leydig, Voit & Mayer

[57] ABSTRACT

A vacuum pipe for use in a synchrotron orbit radiation device includes a vacuum pipe body made of a thin non-magnetic material surrounding a charged particle beam propagating on an annular path, a port portion cell interposed in the vacuum pipe body surrounding part of the path, and a port mounted on the port wall tangential to the path for introducing radiation. The vacuum pipe body has a smooth inner wall surface and reinforcing ribs on an outer wall surface. A wall of the port portion cell located on an outer diameter side of the path is oblique to the wall of the port portion cell on the inner diameter side.

7 Claims, 2 Drawing Sheets

VACUUM PIPE FOR SYNCHROTRON ORBIT RADIATION DEVICE

BACKGROUND OF THE INVENTION

1. Field of the Invention

The present invention relates to a vacuum pipe for use in a synchrotron orbit radiation device for accelerating and storing charged particles, e.g., electrons, to generate synchrotron radiation light.

2. Description of the Related Art

FIG. 3 is a cross-sectional view of a vacuum pipe of a conventional synchrotron orbit radiation device described in, for example, pp 9 to 14 of Balker Review vol 14, No. 11.

In FIG. 3, a charged particle beam, e.g., an electron beam, is deflected with a deflection center 1 as a center thereof and proceeds on a circular path 2. A vacuum pipe body 3 is provided such that it surrounds this electron beam. The vacuum pipe body 3 is made of a thin bellow-type stainless steel.

A port portion cell 4 is interposed in the vacuum pipe body 3 in such a manner that it surrounds part of the electron beam path 2. The port portion cell 4 is also formed of a bellow-type stainless steel, like the vacuum pipe body 3, but is extended in the outer diameter direction of the path 2 relative to the vacuum pipe body 3.

The port portion cell 4 has a port 5 through which the synchrotron radiation emitted by the electron beam is introduced externally. The port 5 is opened in the tangential direction of the path 2.

In the thus-arranged vacuum pipe for use in the conventional synchrotron orbit radiation device, an accelerated electron beam emits synchrotron radiation in the tangential direction of the path 2 at the port portion 3 shown in FIG. 3. The generated radiation is externally introduced from the port 5.

If eddy currents are induced along the metallic wall of the vacuum pipe during the radial acceleration of the electron beam within the vacuum pipe, the deflecting magnetic field is adversely affected and the path 2 is made unstable. Most of such eddy currents flow along the path 2.

In the above-described vacuum pipe, since the vacuum pipe body 3 and the port portion cell 4 are formed by using a bellows made of a thin non-magnetic material, the resistivity of the wall portion along the path 2 is substantially increased, and generation of eddy currents is thus prevented.

In the above-described vacuum pipe for use in the conventional synchrotron orbit radiation device, the vacuum pipe body 3 and the port portion cell 4 are formed by using a welded bellows whose cross-sectional diameter changes in the direction of propagation of an electron beam. Therefore, as the electron beam passes, a wake may be formed on the wall portion. The wake adversely affects the deflecting magnetic field, like the eddy currents, and makes the path 2 unstable. Furthermore, the formation of a wake is increased at the port portion cell 4 because it has an increased cross-sectional diameter.

SUMMARY OF THE INVENTION

Accordingly, an object of the present invention is to provide a vacuum pipe for use in a synchrotron orbit radiation device which reduces the formation of wakes to make the orbit of a charged particle beam stable.

A vacuum pipe for use in a synchrotron orbit radiation device according to the present invention uses a vacuum pipe . body whose inner wall surface is smooth and which has reinforcing ribs on an outer peripheral portion. An outer diameter side wall of a port portion cell is inclined relative to an inner diameter side wall in the same direction as a port.

In the present invention, formation of wakes is reduced by making the inner wall surface of the vacuum pipe body smooth and by eliminating the shoulder between the vacuum pipe body and the port portion cell.

DETAILED DESCRIPTION OF THE PREFERRED EMBODIMENTS

Figure 1:
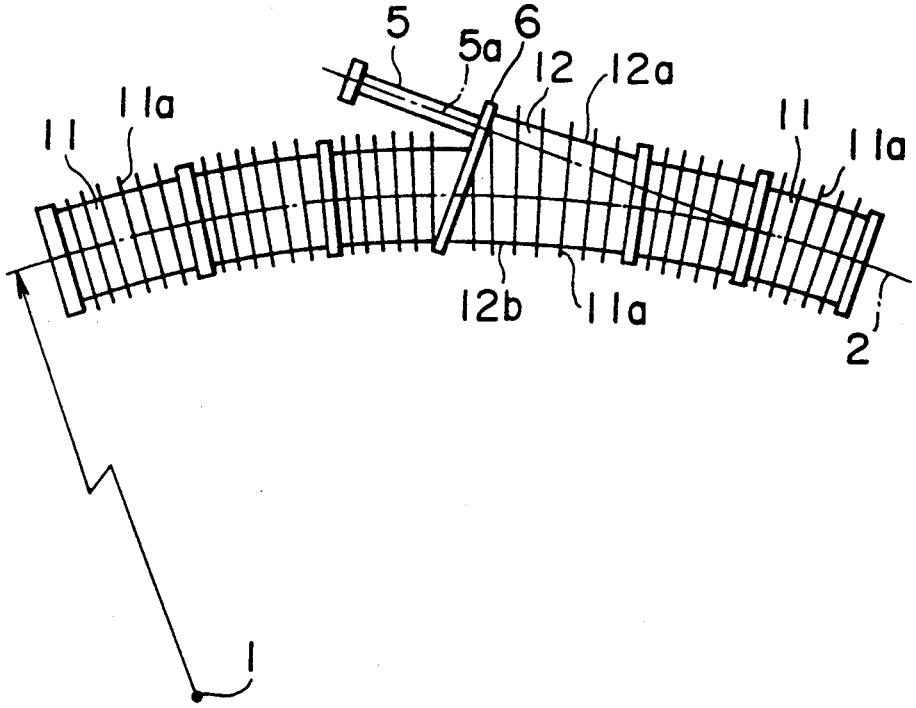
FIG. 1 is a plan view of a deflecting portion of a vacuum pipe for use in a synchrotron orbit radiation device, showing an e of the present invention.
Figure 1A:
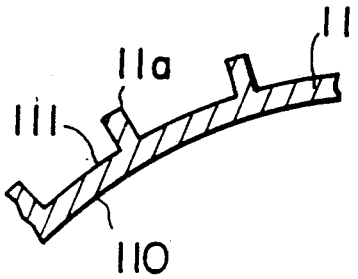
FIG. 1A is a cross-sectional view of part of a wall of a vacuum pipe body of FIG. 1.
Figure 3:
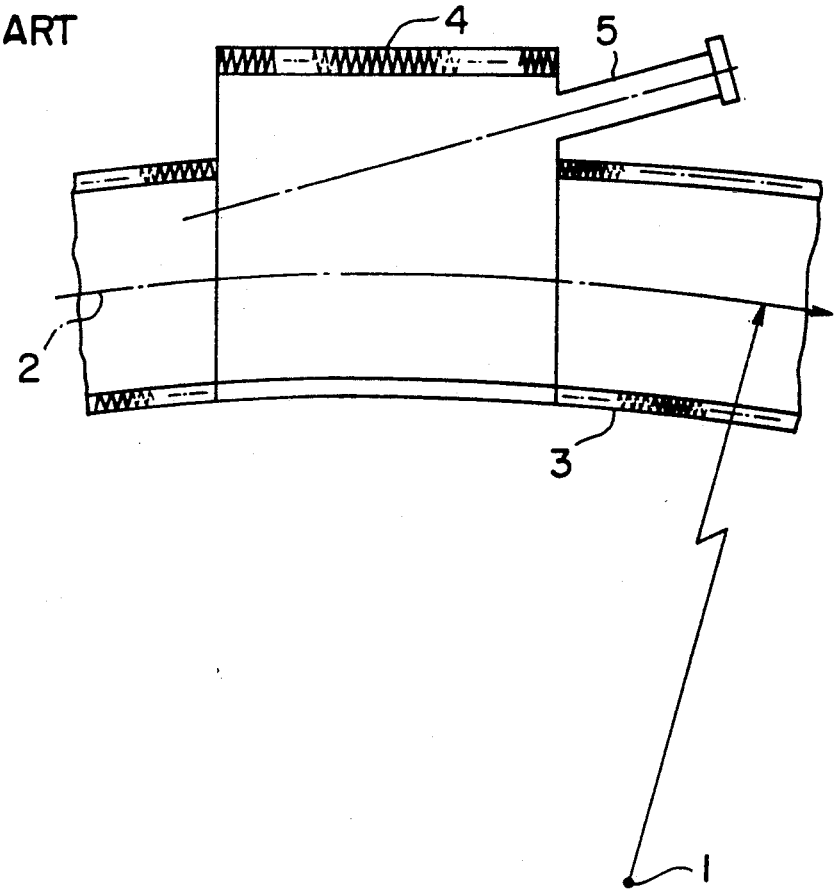
FIG. 3 PRIOR ART
FIG. 3 is a cross-sectional view of a vacuum pipe for use in a conventional synchrotron orbit radiation device.

An embodiment of the present invention will be described below with reference to FIGS. 1 and lA. In FIGS. 1 and 1A, the same reference numerals are used to denote parts or components which are the same as those shown in FIG. 3. The cross-section form of the vacuum pipe body and port portion cell, taken in a direction perpendicular to the orbit of an electron beam may be elliptical, circular or rectangular.

In FIG. 1, a vacuum pipe body 11 provided along the path 2 so that it surrounds an electron beam is made of a thin non-magnetic material (e.g., stainless steel), and has a smooth inner wall surface 110. The smooth surface refers to a surface having no irregularities, unlike the conventional bellows. A large number of outwardly extending ribs 11*a* are provided on an outer wall surface 111 of the vacuum pipe body 11 at predetermined intervals in the longitudinal direction of the body 11 (in the direction along the path 2) to reinforce the vacuum pipe body 11. Each of the ribs ll*a* extends along a plane perpendicular to the path 2 over the entire circumference of the outer wall surface 111. Ribs ll*a* for a port portion cell 12, which will be described later, are provided similarly.

A port portion cell 12 interposed in the vacuum pipe body 11 such that it forms part of the path 2 is made of the same material as the vacuum pipe body 11, and has a smooth inner wall surface, like the vacuum pipe body 11. The port portion cell 12 has a port wall 6 transverse to and extending from the vacuum pipe body at one end of the port portion cell 12. The tubular port 5 is mounted on and extends from the wall 6 tangential to the path 2. Ribs 11*a* are disposed on the outer wall surface of the port portion cell 12. A wall 12*a* of the port portion cell 12 located on the outer diameter side of the path 2 is inclined relative to a wall 12*b* thereof located on the inner diameter side of the path 12 tangential to the path 2. That is, in this embodiment, the outer diameter wall 12*a* is substantially parallel to a center line 5*a* of the port 5.

In the thus-arranged vacuum pipe for use in the synchrotron orbit radiation device, since the inner wall surface of the vacuum pipe body 11 and port portion cell 12 is smooth, the generation of wakes caused by passage of the electron beam is reduced. Furthermore, since the outer diameter wall 12*a* of the port portion cell 12 is inclined in the same direction as the port 5, a rapid change in the cross-sectional diameter between the vacuum pipe, body 11 and the port portion cell 12 does not occur, also reducing the generation of wakes.

Consequently, the stability of the path 2 and performance of the acceleration and storage rings are improved, and reliability of the synchrotron orbit radiation device is thus improved. Furthermore, since the welded bellows are not used, the production cost is reduced.

A reduction in the strength of the vacuum pipe body 11 and port portion cell 12, caused by the smooth wall surface, is compensated for by the provision of the ribs ll*a*.

Figure 2:
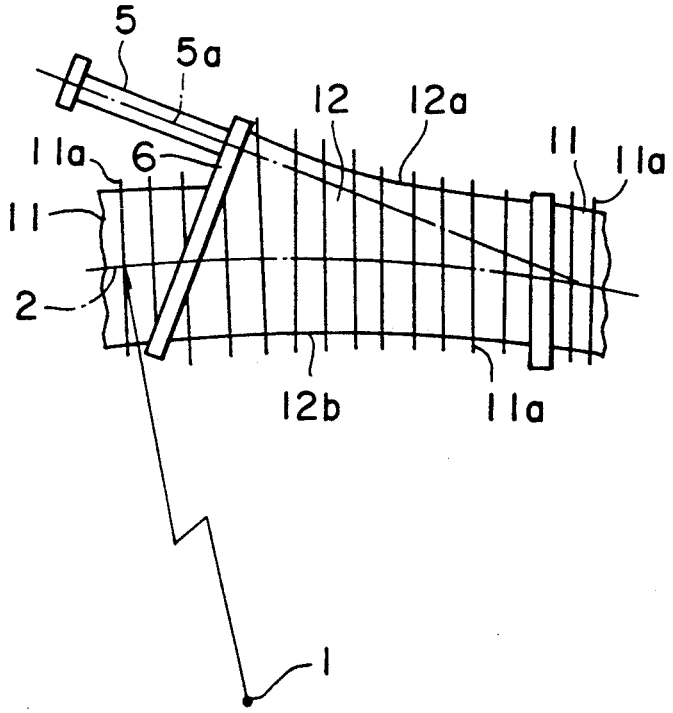
FIG. 2 is a plan view of a deflecting portion of a vacuum pipe for use in a synchrotron orbit radiation device, showing another embodiment of the present invention.

In this embodiment, the outer diameter wall 12*a* of the port portion cell 12 is substantially parallel to the center line 5*a* of the port 5. However, it may be smoothly curved toward the port 5, as shown in FIG. 2.

The present invention can also be applied to a vacuum pipe having a plurality of port portion cells 12 and ports 5.

This embodiment employs, as a charged particle beam, an electron beam. However, a positively charged beam may also be used.

Furthermore, the non-magnetic material of the vacuum pipe is not limited to stainless steel.

As will be understood from the foregoing description, the vacuum pipe for use in the synchrotron orbit radiation device includes a vacuum pipe body having a smooth inner wall surface and reinforcing ribs on the outer wall surface thereof, and a port portion cell whose outer diameter side wall is inclined toward the port 5 relative to the inner diameter side wall thereof. Consequently, a rapid change in the cross-sectional diameter is avoided, and the formation of wakes is reduced, thus improving stability of the orbit of the charged particle beam. As a result, the synchrotron orbit radiation is improved, the production cost is reduced.

What is claimed is:

1. A vacuum pipe for use in a synchrotron orbit radiation device comprising:

a vacuum pipe body for surrounding part of an annular path traversed by a charged particle beam, said vacuum pipe body being formed of a thin tube made of a non-magnetic material and having a smooth inner wall surface and an outer wall surface with a plurality of reinforcing ribs disposed on the outer wall surface transverse to the path; and at least one port portion cell having opposed ends and interposed between parts of said vacuum pipe body surrounding part of said path, said port portion cell being formed of a thin tube made of a non-magnetic material and having a smooth inner wall surface and an outer wall surface with a plurality of reinforcing ribs disposed on the outer wall surface transverse to the path, said port portion cell including a port wall transverse to and extending from said vacuum pipe body at one end of said port portion cell, a tubular port mounted on and extending from said port wall tangential to the path for introducing radiation, wherein said port portion cell has an inner diameter wall located inside the path and an outer diameter wall located outside the path, deviating from said outer wall surface of said vacuum pipe body toward said tubular port, oblique to said inner diameter wall, and substantially tangent to the path.

2. A vacuum pipe body for use in a synchrotron orbit radiation device according to claim 1 wherein said outer diameter wall of said port portion cell is smoothly curved toward said port.

3. A vacuum pipe body for use in a synchrotron orbit radiation device according to claim 1 wherein said ribs are disposed on the outer wall surface of said vacuum pipe tube and said port portion cell at spaced apart intervals.

4. A vacuum pipe body for use in a synchrotron orbit radiation device according to claim 1 wherein said vacuum pipe body and said port portion cell are stainless steel.

5. A vacuum pipe body for use in a synchrotron orbit radiation device according to claim 1 wherein the charged particle beam propagating along the path comprises an electron beam.

6. A vacuum pipe body for use in a synchrotron orbit radiation device according to claim 1 wherein the charge particle beam propagating along the path comprises a positively charged beam.

7. A vacuum pipe body for use in a synchrotron orbit radiation device according to claim 1 wherein each of the ribs lies in a plane substantially perpendicular to said path over an entire circumference of the outer wall surface.

* * * * *